US005431238A

United States Patent [19]

Trevisani

[11] Patent Number: 5,431,238

[45] Date of Patent: Jul. 11, 1995

[54] DRILLING TOOL FOR USE IN CONSTRUCTING LARGE DIAMETER PILES, VENTILATING SHAFTS AND OTHER SIMILAR MINING WORKS

[75] Inventor: Davide Trevisani, Cesena, Italy

[73] Assignee: Trevi S.p.A., Cesena, Italy

[21] Appl. No.: 254,635

[22] Filed: Jun. 8, 1994

[30] Foreign Application Priority Data

Jun. 9, 1993 [IT] Italy ..... TO93A0417

[51] Int. Cl.[6] ..... E21B 10/06; E21B 1/06

[52] U.S. Cl. ..... 175/308; 299/56; 299/90

[58] Field of Search ..... 175/91, 203, 308, 312, 175/320, 325.3, 373; 299/56, 90

[56] References Cited

U.S. PATENT DOCUMENTS 4,330,155 5/1982 Richardson et al. ..... 299/56 X
5,199,515 4/1993 Sinclair et al. ..... 175/325.3 X
5,325,932 7/1994 Anderson et al. ..... 175/325.3

FOREIGN PATENT DOCUMENTS 1186428 4/1965 Germany ..... 175/308
1067189 1/1984 U.S.S.R. ..... 175/308
1079815 3/1984 U.S.S.R. ..... 175/308

*Primary Examiner*—David J. Bagnell
*Attorney, Agent, or Firm*—Merchant, Gould, Smith, Edell, Welter & Schmidt

[57] ABSTRACT

A drilling tool is adapted for being releasably mounted to a lower end of a rod string (20) of a drilling rig (30) and includes a container (2) having a cylindrical or truncated-cone shape fitted at the lower end with a plurality of cutting tools or cutters (10) for crushing rock. The drilling tool (1) further includes a plate (3) for releasably retaining a plurality of modular elements (14) forming a load (13), and curved blades (9), which are located proximate to the cutting tools (10), adapted for conveying rock spalls into the container (2) through suitable apertures (8) in a bottom of the container (2). The cutting tools (10) are mounted to a plurality of radial plates (7) securely fixed proximate to the bottom edge of the container (2). The curved blades are welded to the edges of the radial plates (7), the concavity of each blade (9) being arranged facing the direction of rotation of the drilling tool (1).

7 Claims, 4 Drawing Sheets

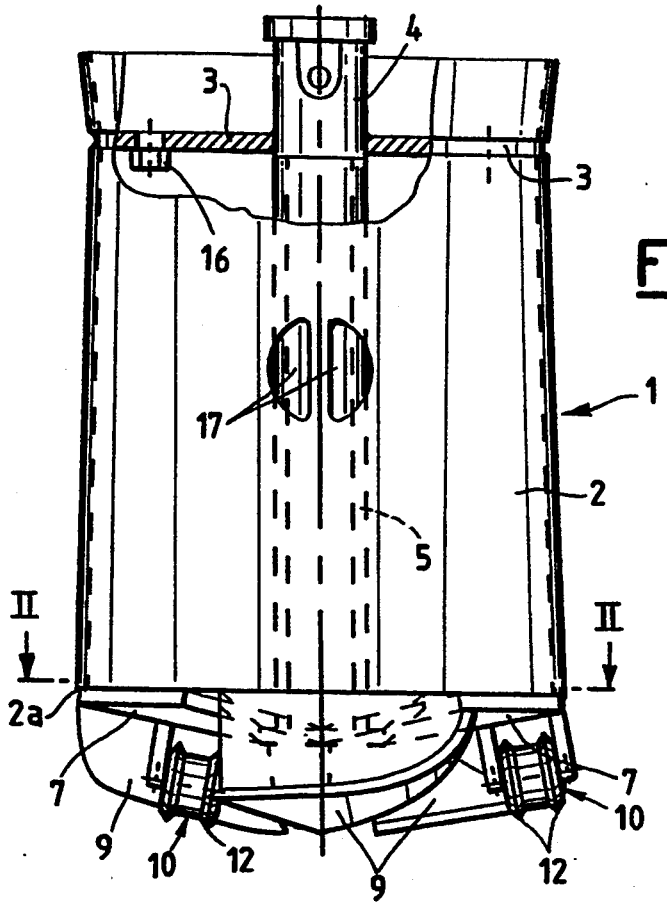
Fig.1
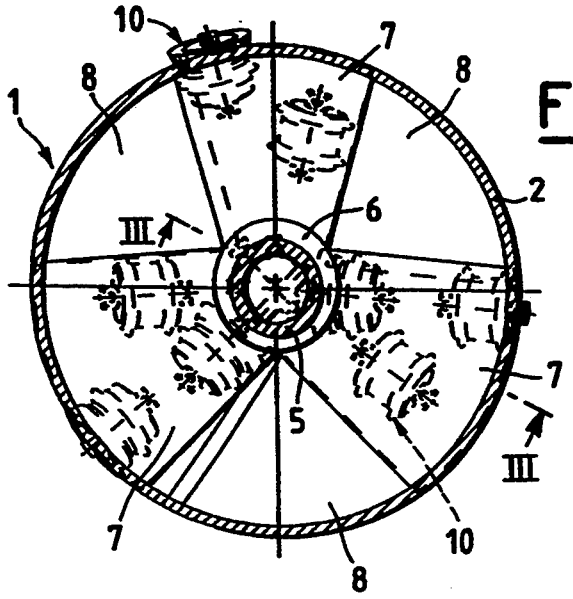
Fig.2
Fig.3
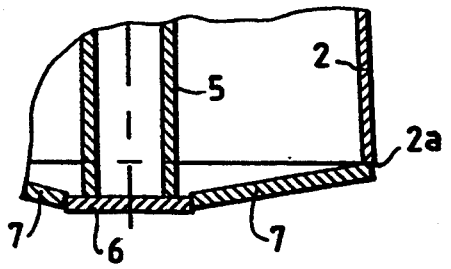

DRILLING TOOL FOR USE IN CONSTRUCTING LARGE DIAMETER PILES, VENTILATING SHAFTS AND OTHER SIMILAR MINING WORKS

The present invention refers to a rock drilling tool for use in constructing large diameter piles, ventilating shafts and other similar mining works.

At present, in the field of large diameter piles drilling (i.e. piles having a diameter ranging within 600 and 2500 mm), some of the major difficulties are encountered in drilling operations where rocky soil or bedrock is found. The same difficulty arises also if only the base of the pile has to be fixed in the bedrock. In some cases, the above difficulty can seriously compromise the possibilities of constructing a pile workmanlike or in task time.

Known large diameter pile drilling methods and relevant Jigs and fixtures are currently used for drilling loose non-cohesive kinds of soil (sand and gravel) or cohesive soil (clay and silt). At most, these implements are used for drilling rather thin layers of rock characterized by having compressive strength not exceeding 200–300 kg/cm$^2$ (comparable to the compressive strength of concrete).

Large diameter piles drilling operations are usually carried out exploiting drilling rigs equipped with rotary tables and drilling tools consisting of buckets, or drills connected to rotaries through telescopic extractable rods. Buckets and drills are fitted with excavating teeth in the shape of blades, peaks or buttons.

The thrust required for the teeth to penetrate the soil is provided by pull-down systems applied to the rotary.

The telescopic elements forming the rod connecting buckets and drills to rotaries have been modified so as to increase penetration capacity of the teeth fitted to the tools and allow drilling of compact kinds of soil and brittle rock. Therefore, conventional thrust transmission friction systems employing strips welded to the rods have been replaced by mechanical locking systems for locking the rods together, whereby higher thrust values are transferable. Also, more powerful hydraulic pulldown systems have been recently used.

Despite these important improvements, it is generally not possible to drill rocks having resistance values above 500 kg/cm$^2$. However, the advancing rate is not satisfactory from an industrial production point of view.

At present, solutions adopted for drilling large diameter piles in rocks having resistance values exceeding 500 kg/cm$^2$ or in thick layers of rock, all generally involve core boring operations to weaken the section that has to be drilled. The above cited core boring operations are generally carried out by a series of tools known as core barrels, that are mounted in the place of the buckets and drills. The core barrels provide an incision in the rock around the outer perimeter of the pile or following circles having a smaller diameter than that of the pile. The incision forms a weakening that is employed for crushing the rock by means of a piercing bit that is repeatedly lifted up and let fall down freely until the rock is completely crushed. Core barrels are equipped with rotating teeth (three-cone rollers) or hard metal inserts. Reduced thickness of the walls of the core barrel allows penetration of hard rock, but the same operation of the core barrel may compromise the stability of the walls of the bore.

As briefly discussed, rock perforation often encounters major operation difficulties in the construction of large diameter piles. Generally, the rate of advancement of the excavation is about 6–10 m/h for loose soil, but decreases to 0.5–1.5 m/h for solid rock.

In some fields of civil engineering other than pile construction, such as large diameter tunnel excavation (for diameters ranging from 3 to 12 meters), drilling of very hard rock (having compressive strength exceeding 1000 kg/cm$^2$) is made possible by exploiting full section drilling machines equipped with a rotating disc the diameter of which corresponds to the that of the tunnel that is excavated. Suitable cutters such as disc-like blades are arranged on the rotating disc so as to cover substantially all the surface of the breast during rotating motion. Owing to the thrust that is applied to the rotating disc, said disc-like cutters engrave the breast surface in concentric circles, thereby spalling the rock in correspondence of the adjacent grooves formed by the wedged profile of the cutters. This method provides a rate of advancement of 10–15 m/h and more in hard rock.

It is an object of the present invention to provide a rock drilling tool capable of drilling also very hard rocks for the construction of large diameter piles, ventilating shafts and other similar mining works.

It is another object of the present invention to provide a drilling tool that can be mounted to conventional drilling apparatuses without having to modify these apparatuses considerably.

A further object of the invention is to provide a drilling tool which can be quickly adapted in operation for drilling rocks higher or lower in strength by adding or removing accessory weights.

These and further objects and advantages, which will become apparent hereinafter, are attained according to the invention by a rock drilling tool for use in constructing large diameter piles, ventilating shafts and other similar mining works, adapted for being releasably mounted to the lower end of a rod string of a drilling rig, characterized in that it comprises a container having a substantially cylindrical or truncated-cone shape fitted at its lower end with a plurality of cutting tools or cutters for crushing rock; said drilling tool further comprising:

support means for releasably retaining a plurality of modular elements forming a load; and scoop means, located proximate to said cutting tools, adapted for conveying rock spalls into said container through suitable apertures in the bottom of said container.

The structural and operational characteristics of a preferred but not limiting embodiment of the drilling tool according to the present invention are described hereinafter with reference to the accompanying drawings, in which:

FIG. 1 is a front view of a drilling tool according to the invention with some parts broken off for illustration purposes;

FIG. 2 is a horizontal cross sectional view on the line II—II of FIG. 1;

FIG. 3 is a partial vertical cross section view on line III—III of FIG. 2;

Figure 7:
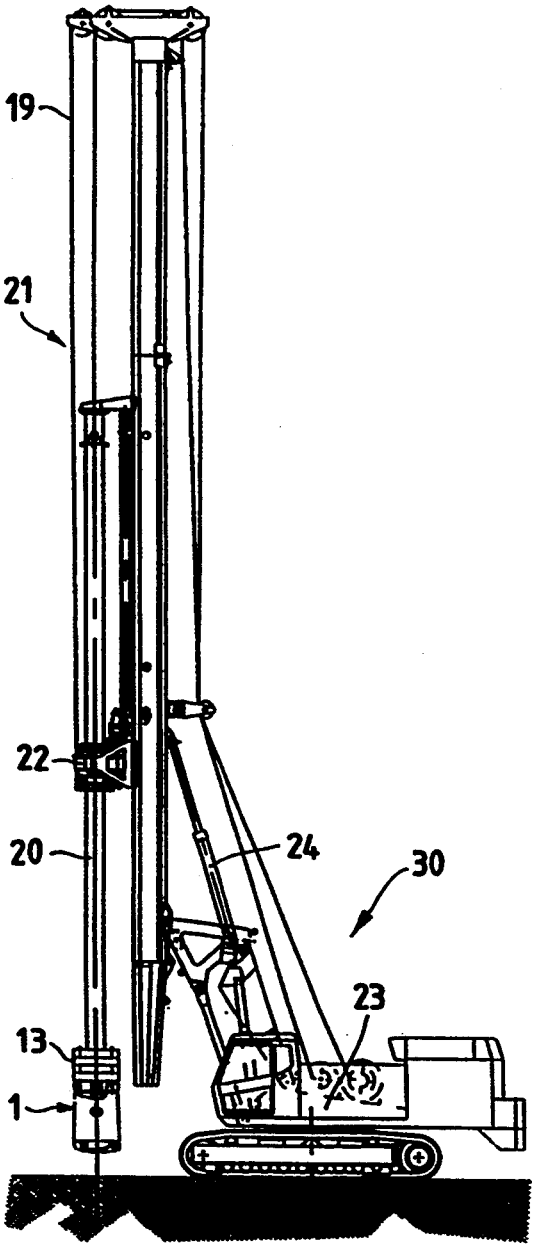
FIG. 7 is a side view of a drilling rig fitted with the tool according to the invention.

With reference initially to the overall view of the drilling rig shown in FIG. 7, reference numeral 1 indicates generally a drilling tool according to the invention, designed to drill rock for ventilating shafts and large diameter piles construction. The drilling tool 1 is mounted to the lowermost of a telescopic rod string 20 of a drilling rig 30. The kind of rig, of which an example is given in the drawings, is not to be considered limiting, as any kind of a rig that is suitable for use with a drilling tool of the invention can be used. In the example of FIG. 7, the rods 20 are rotated by a conventional rotary head 22. The rotary head 22 is vertically movable along a drilling tower 21 which is transported by an articulated quadrilateral linkage 24, a crawler tracked tractor 23.

More particularly, referring to FIGS. 1, 2 and 3, the tool 1 of the invention consists of a thin wall metal container 2 substantially cylindrical or truncated-cone in shape. The container 2 is upwardly tapered and welded at the top to an upper plate 3 which is fixedly connected to a standard socket 4 for attaching to the telescopic rods 20 (shown in FIG. 4) connecting to the rotary head 22 (shown on FIG. 7). A tubular member 5 is disposed coaxially in the center of the container 2. Tubular member 5 is slightly longer than the container 2 and has its bottom end portion welded to a circular plate 6 (FIG. 3), whilst its upper end portion is welded to the socket 4. The bottom circular plate 6 is securely fixed to the lower edge 2*a* of the truncated-cone container 2 by means of three radial plates or blades 7 disposed at equal angles around the vertical axis. The radial plates 7 are slightly inclined downwardly and towards the central axis, as the circular plate 6 is somewhat below the edge 2*a*.

The three radial plates 7 and the edge 2*a* of the container determine three apertures 8 through which the crushed rock is conveyed to the inside of the container 2, as will appear more clearly hereinafter. With the aim of facilitating crushed rock penetration into the container 2, the drilling tool 1 is fitted with three lower helical curved blades 9. Each blade 9 is welded to one of the two radial edges of radial plates 7 adjacent to the apertures 8. The concavities of the blades 9 are facing the direction of rotation of the drilling tool 1, counterclockwise according to FIG. 2.

Figure 4:
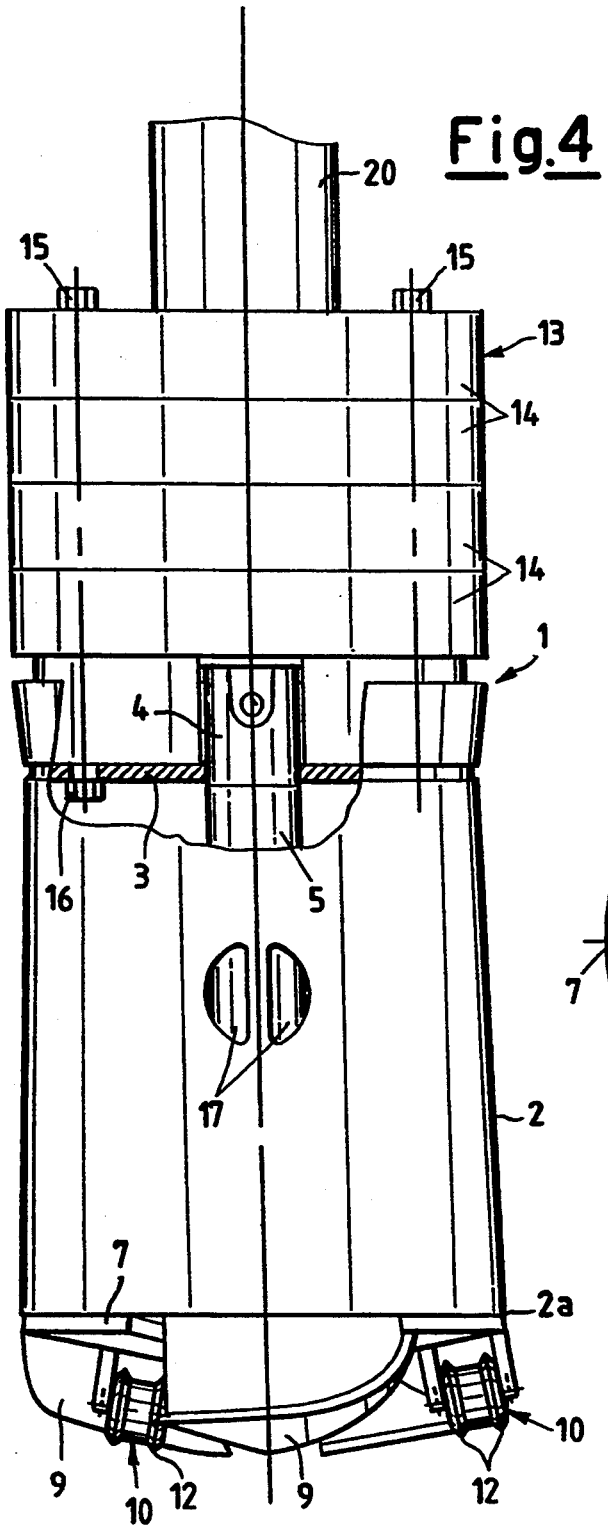
FIG. 4 is a front view of the tool of FIG. 1 provided with further operational implements.
Figure 5:
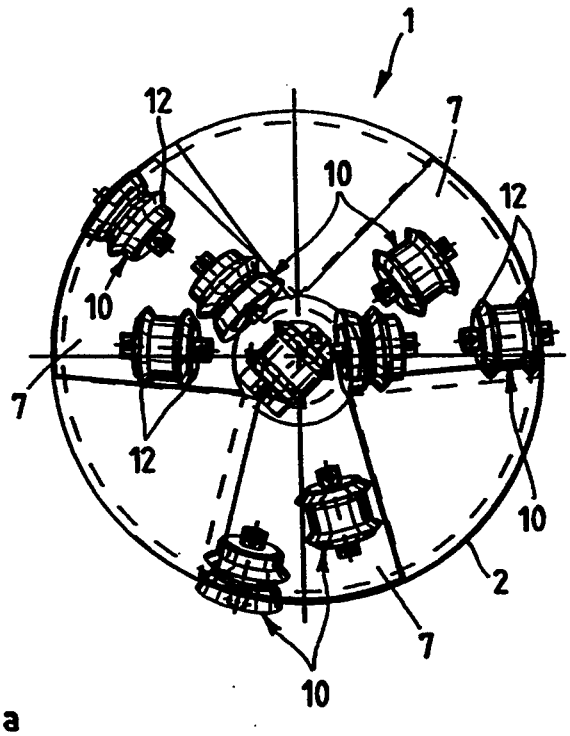
FIG. 5 is a bottom view of the tool of FIG, 4.
Figure 6:
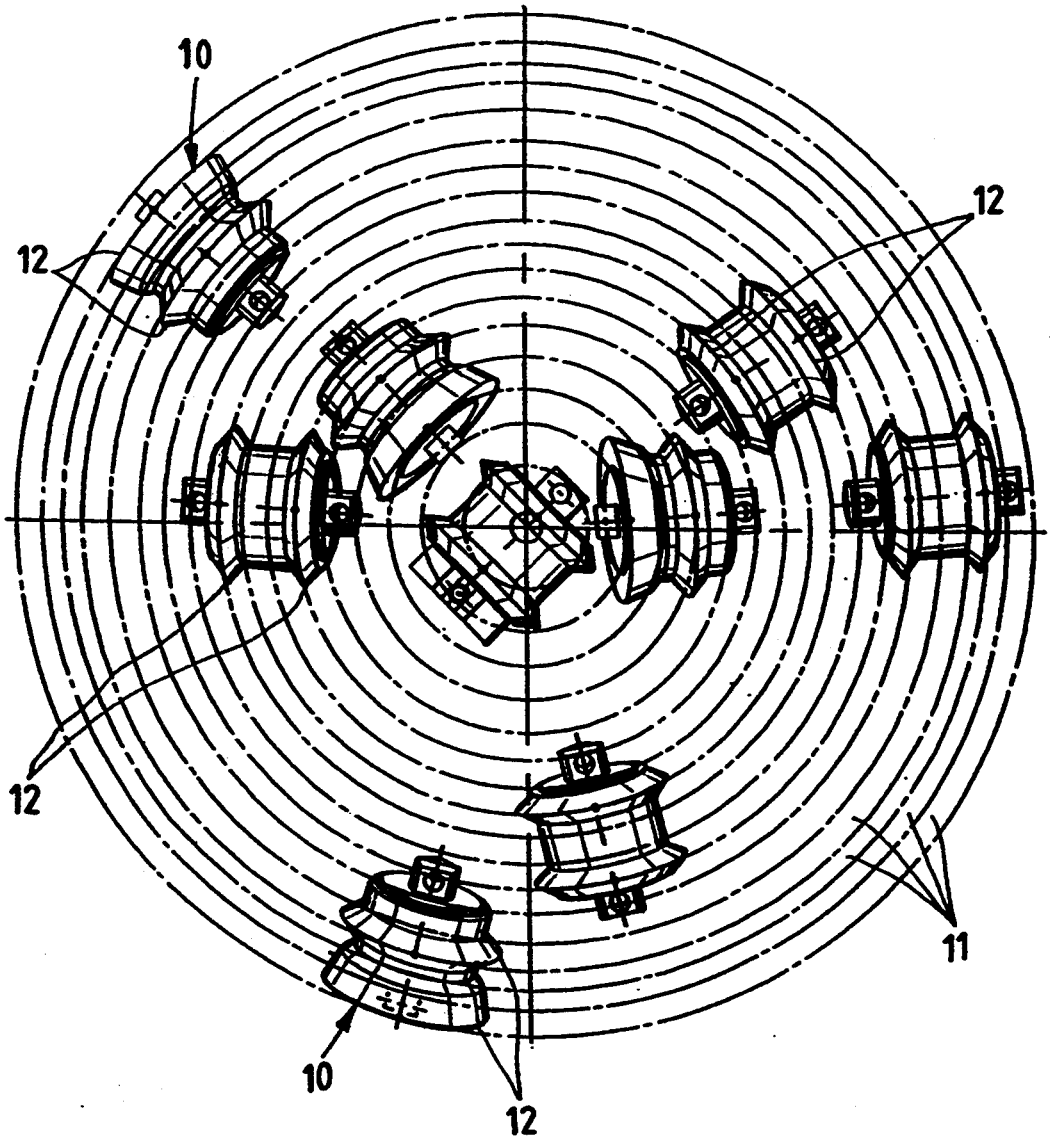
FIG. 6 illustrates the cutting grooves obtained by the use of the drilling tool of FIGS. 4 and 5.

With reference to FIGS. 4 and 5, cutters 10 are mounted to plate 6 and radial plates 7. The cutters 10 are of the rotating disk kind currently used with drilling machines for tunnelling, and may vary in number, kind (with one or two cutting disks, as shown in FIGS. 4 and 5), and diameter, as a function of the bore or pile diameter to be drilled. However, the cutters are disposed so that their paths will uniformly cover the entire drilling section. Moreover, the cutters are arranged so as to get the center of thrust to coincide with the vertical axis of the drilling tool. FIG. 6 shows the cutting paths 11 of the cutting members 12 of the cutters 10. As shown, the paths 11 are distributed uniformly on the entire section. The spacing between two adjacent paths represents the cutting pitch and therefore the size according to which the rock is chipped and crushed. Rock fracturing occurs by interaction of the rotating disks and the adjacent cuttings similarly to full section drilling machines for tunnelling. Further, the cutters are distributed on the inclined plates 7 so as to provide maximum steadiness when the drilling tool rotates about its axis, and maintain the drilled bore vertical.

Referring to FIG. 4, in order to give the cutters the proper thrust that is required for penetration, a predetermined load 13 bearing on the plate 2 must be provided. The load 13 is composed by a plurality of stacked modular elements 14 in which bores are obtained for inserting bolts 15 that securely fasten the elements 14 to the plate 2 by means of nuts 16. A central bore (not shown) is obtained in each element 14 forming the load 13 for inserting same on the rod 20 connected to socket 4.

The number of elements 14 is chosen so as to form a load having a weight capable of providing the cutters with the required thrust. However, said number must be consistent with the lifting power of the on-surface rig 30 (FIGS. 7 and 8) on which the drilling tool is mounted.

Still with reference to FIG. 4, the rock spalls being crushed by the cutters are loaded inside the hollow container 2 by means of the curved blades 9 where the are tamped due to the truncated-cone shape of the container. The rock spalls can be eliminated cyclically when the container is full and the tool is withdrawn, by supplying pressurized water through inlet apertures 17 obtained diametrically in the container 2.

According to a further embodiment (not shown) of the present invention, the inclined plate assembly 7 can be fitted with a hinge located on one of the outer sides of one of said plates so as to be tilted and open the bottom of the container 2, similarly to soil excavation buckets of known kind.

Figure 8:
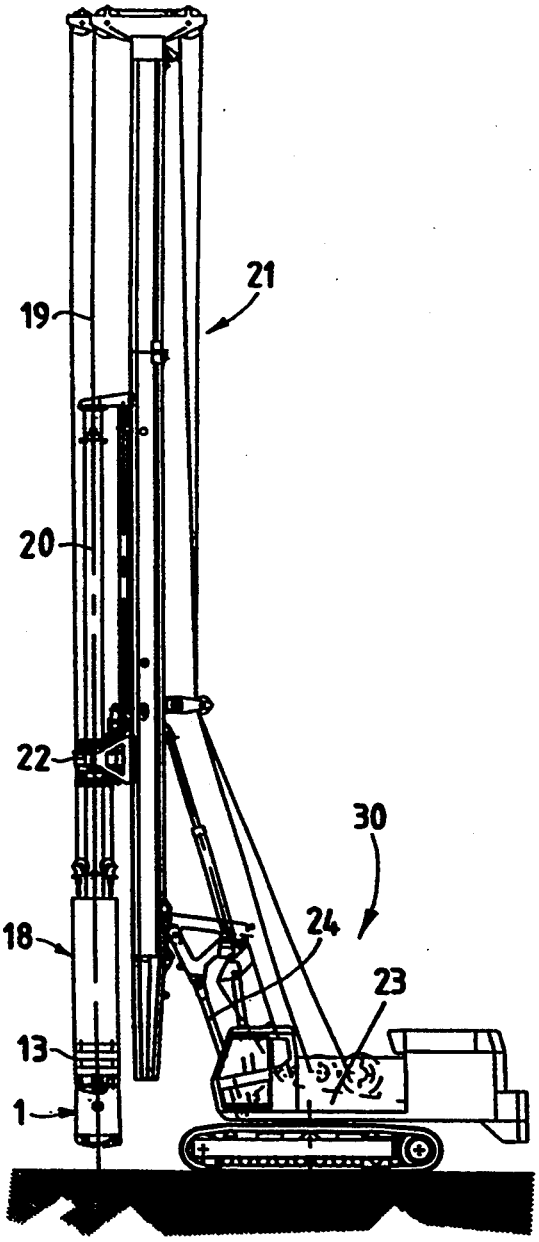
FIG. 8 is a view similar to FIG. 7, in which the drilling tool is fitted with further implements.

Referring to FIG. 8, should a weight heavier than that corresponding to load 13 have to be applied, an additional load 18 may be fitted. The additional load 18 is designed to be assembled in partial elements around the telescopic rods 20 for supporting the drilling tool 1. An auxiliary carrying cable 19 is used to lower the additional load 18 down onto the load 13 at the bottom of the rod. The carrying cable 19 is usually provided on every kind of drilling rig for constructing drilled piles, and is actuated by a separate winch independent of the winch for driving the assembly formed by the telescopic rods, the load 13 and the drilling tool.

When rock drilling is finished, the additional load 18 is lifted and removed before the drilling tool and the load 13 are lifted up.

The system used for coupling, releasing and coupling again the additional load 18 is not shown in the drawings as being of known kind for those skilled in the art.

It will be appreciated that the present invention allows to increase at will the weight acting on the cutters by adding removable loads of a weight adapted for penetrating rocks having a resistance over 2500 kg/cm$^2$ and for piles having a diameter up to 2500 mm without compromising the steadiness of the on-surface rig.

I claim:

1. A rock drilling tool for use in constructing large diameter piles, ventilating shafts and other similar mining works, adapted for being releasably mounted to a lower end of a rod string of a drilling rig, wherein the rock drilling rig comprises a container having a substantially cylindrical or truncated-cone shape fitted at a lower end of the container with a plurality of cutting tools for crushing rock; the drilling tool further comprising:

support means for releasably retaining a plurality of modular elements forming a load; and scoop means, located proximate to the cutting tools, adapted for conveying rock spalls into the container through suitable apertures in a bottom of the container.

2. A rock drilling tool according to claim 1, wherein the cutting tools are mounted to a plurality of radial plates securely fixed proximate to a bottom edge of the container, said plates being equally spaced at a given angle around an axis of the tool so as to determine therebetween said apertures for drawing in rock spalls.

3. A rock drilling tool according to claim 2, wherein said scoop means includes curved blades welded to edges of the radial plates, concavity of each of said blades being arranged facing a direction of rotation of the drilling tool.

4. A rock drilling tool according to claim 2, wherein said radial plates supporting the cutting tools are inclined downwardly towards a central axis of the drilling tool.

5. A rock drilling tool according to claim 1, wherein said supporting means includes a plate closing a top of the container, said plate being fixedly connected to a socket for coupling to the rod string; said modular elements having a central bore for slipping on and being horizontally retained by the socket and the rod string.

6. A rock drilling tool according to claim 1, further comprising an additional load formed by partial elements capable of being assembled around the rod string above the load.

7. A rock drilling tool according to claim 1, further comprising at least one radially disposed aperture as an inlet port for supplying pressurized water for cyclically emptying the container.

* * * * *